US010989506B1

(12) United States Patent
Huang

(10) Patent No.: US 10,989,506 B1
(45) Date of Patent: Apr. 27, 2021

(54) DART

(71) Applicant: Pei Sung Huang, Changhua County (TW)

(72) Inventor: Pei Sung Huang, Changhua County (TW)

( * ) Notice: Subject to any disclaimer, the term of this patent is extended or adjusted under 35 U.S.C. 154(b) by 0 days.

(21) Appl. No.: 17/000,395

(22) Filed: Aug. 24, 2020

(51) Int. Cl.
*A63B 65/02* (2006.01)
*F42B 6/00* (2006.01)

(52) U.S. Cl.
CPC ..... *F42B 6/003* (2013.01)

(58) Field of Classification Search
CPC .... F42B 6/003; F42B 6/04; F42B 6/06; F42B 6/08
See application file for complete search history.

(56) References Cited

U.S. PATENT DOCUMENTS 4,886,280 A * 12/1989 Bottelsen ..... F42B 6/003 473/586
5,388,840 A * 2/1995 Werle ..... F42B 6/003 473/586
5,642,887 A * 7/1997 Orav ..... F42B 6/003 473/586
6,758,772 B1 * 7/2004 Chambers ..... F42B 6/003 473/578
7,108,620 B1 * 9/2006 Yiu ..... F42B 6/003 473/578

* cited by examiner

*Primary Examiner* — John A Ricci
(74) *Attorney, Agent, or Firm* — WPAT, PC

(57) ABSTRACT

A dart including a shaft, a flight, and a cap. The shaft has a body made of flexible materials and a connecting element. The connecting element has a connecting section and multiple insertion slits. Each one of the multiple insertion slits has an open end. The flight has multiple wings and a receiving groove. Each one of the multiple wings is inserted into a respective one of the multiple insertion slits. The receiving groove is formed through the multiple wings. The cap is detachably mounted in the receiving groove, is mounted to the connecting section, and blocks the open end of each one of the multiple insertion slits.

10 Claims, 7 Drawing Sheets

DART

BACKGROUND OF THE INVENTION

1. Field of the Invention

The present invention relates to a dart, and more particularly to a dart having a body unlikely to fracture in collision with other darts, having a body unlikely to fracture when falling on a ground, having slighter deviation in its flight path in collision with other darts, and ensuring a flight thereof will not be detached.

2. Description of Related Art

With reference to FIGS. 6 and 7, a conventional dart 70 in accordance with the prior art includes a shaft 71, a barrel 72, a tip 73, and a flight 74. The shaft 71 is made of hard materials such as metal materials or plastic materials. The shaft 71 has a threading section 711 and four insertion slits 712. The threading section 711 is disposed at one of two ends of the shaft 71. Each one of the four insertion slits 712 is formed in one of the two ends of the shaft 71 away from the threading section 711. The four insertion slits 712 are disposed at equi-angular intervals and communicate with one another. The barrel 72 has a threaded groove 721 formed in one of two ends of the barrel 72 adjacent to the shaft 71. The barrel 72 and the shaft 71 are threaded together via the threaded groove 721 and the threading section 711. The tip 73 is disposed at one of the two ends of the barrel 72 away from the shaft 71. The flight 74 is detachably mounted in the four insertion slits 712 of the shaft 71 and has four wings 741. Each one of the four wings 741 is inserted into a respective one of the four insertion slits 712 of the shaft 71.

A dart player usually assembles the shaft 71, the barrel 72, and the tip 73 together and puts the assembly and the flight 74 into a dart case. The flight 74 is mounted to the shaft 71 only when the conventional dart 70 is ready for use.

However, the conventional dart 70 lacks a counterweight structure between the shaft 71 and the barrel 72. Moreover, in a dart game, if more than one conventional dart 70 is aimed at a same target on a dartboard, the conventional dart 70 that has already been stuck on the dartboard will hit the latter thrown conventional dart 70. In this case, the following circumstances may happen:

1. Since the shaft 71 of the conventional dart 70 is made of hard materials such as metal materials or plastic materials, when two said conventional darts 70 hit each other, the shaft 71 of each one of the two said conventional darts 70 may fracture or break. Furthermore, the latter thrown conventional dart 70 may be hit by the shaft 71 of the conventional dart 70 stuck on the dartboard and bounce off. Under this circumstance, the latter thrown conventional dart 70 scores no point.

2. The four insertion slits 712 of the shaft 71 of the conventional dart 70 stuck on the dartboard are prone to be hit by the tip 73 of the latter thrown conventional dart 70, and the four insertion slits 712 may be deformed to enlarge the intervals among the insertion slits 712, leading to the detachment of the flight 74. In case that the four insertion slits 712 are expanded, the flight 74 may not be mounted in the four insertion slits 712 of the shaft 71 stably and the conventional dart 70 with the expanded insertion slits 712 may not be useful anymore.

3. When the conventional dart 70 falls on a ground, the shaft 71 tends to fracture because the shaft 71 is made of hard materials such as metal or plastic materials.

4. An engagement between the barrel 72 and the shaft 71 tends to loosen after long-time use or collisions since the barrel 72 and the shaft 71 are threaded together merely via the threaded groove 721 and the threading section 711.

To overcome the shortcomings of the conventional dart 70, the present invention tends to provide a dart to mitigate or obviate the aforementioned problems.

SUMMARY OF THE INVENTION

The main objective of the present invention is to provide a dart that has a body unlikely to fracture in collision with other darts, has a body unlikely to fracture when falling on a ground, has slighter deviation in its flight path in collision with other darts, and ensuring a flight thereof will not be detached.

The dart includes a shaft, a barrel, a tip, a flight, and a cap. The shaft has a body and a connecting element. The body is made of flexible materials. The connecting element is disposed at one of two ends of the body and has a connecting section and multiple insertion slits. The connecting section is disposed at one of two ends of the connecting element away from the body. The multiple insertion slits are disposed at spaced intervals and communicate with one another. Each one of the multiple insertion slits has an open end away from the body. The barrel is disposed at one of two ends of the shaft adjacent to the body.

The tip is disposed at one of two ends of the barrel away from the shaft. The flight has multiple wings and a receiving groove. The multiple wings are disposed at spaced intervals, and each one of the multiple wings is inserted into a respective one of the multiple insertion slits of the connecting element of the shaft. The receiving groove is formed through the multiple wings. The cap is detachably and rotatably mounted in the receiving groove of the flight, is mounted to the connecting section of the connecting element, and blocks the open end of each one of the multiple insertion slits.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
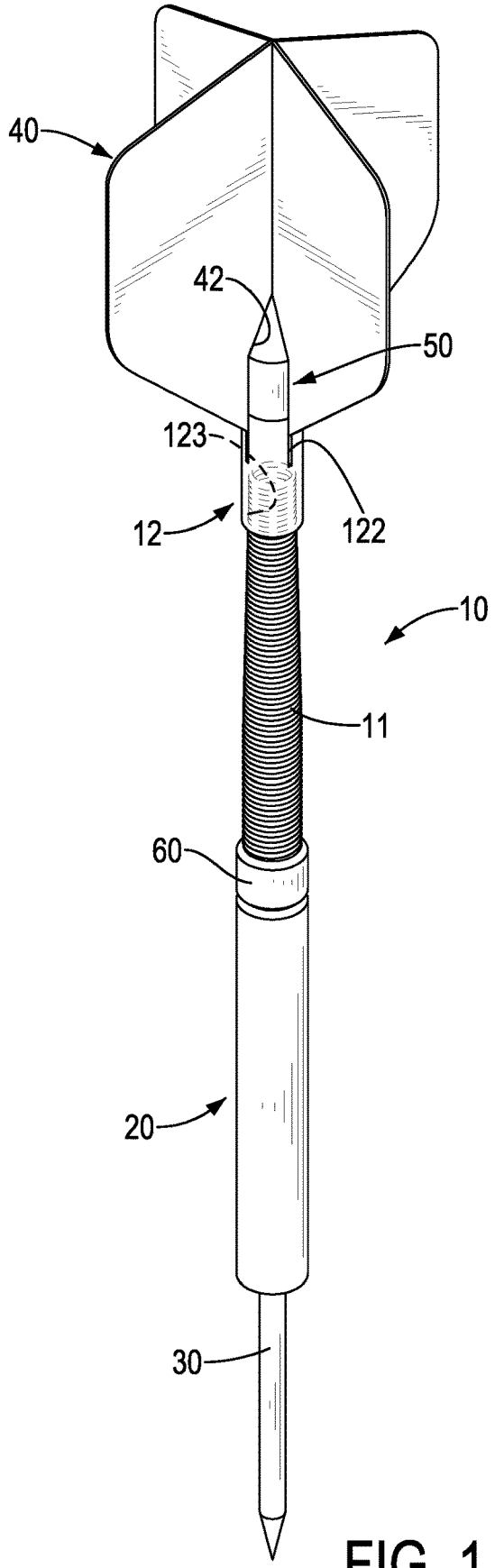
FIG. 1 is a perspective view of a dart in accordance with the present invention.
Figure 2:
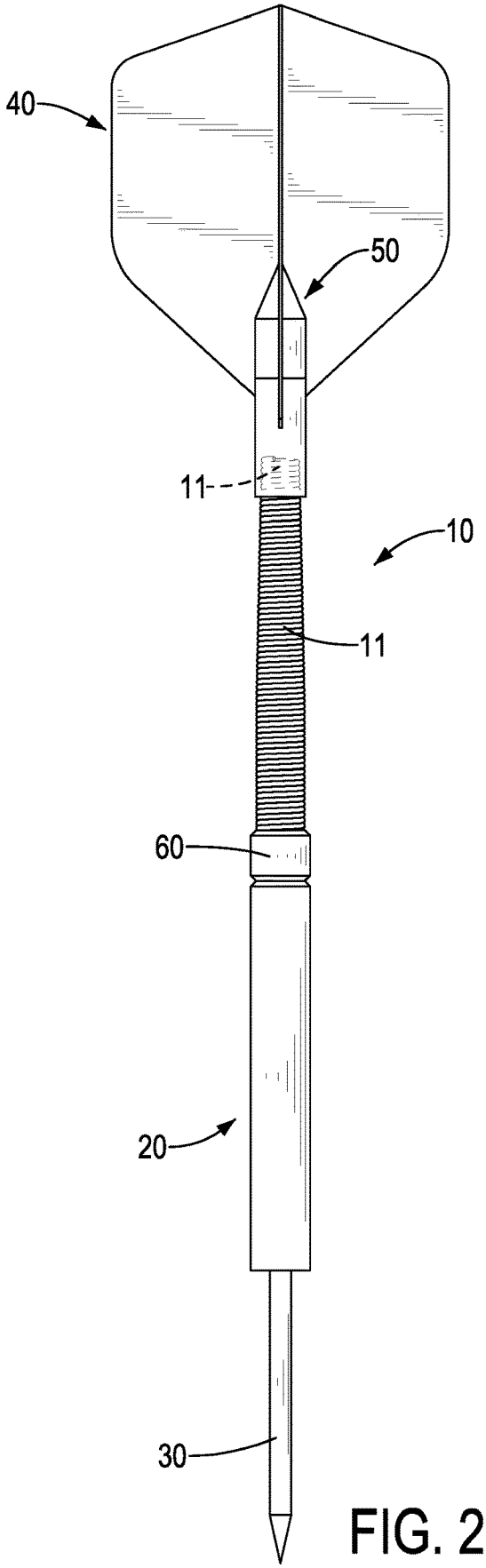
FIG. 2 is a side view of the dart in FIG. 1.
Figure 3:
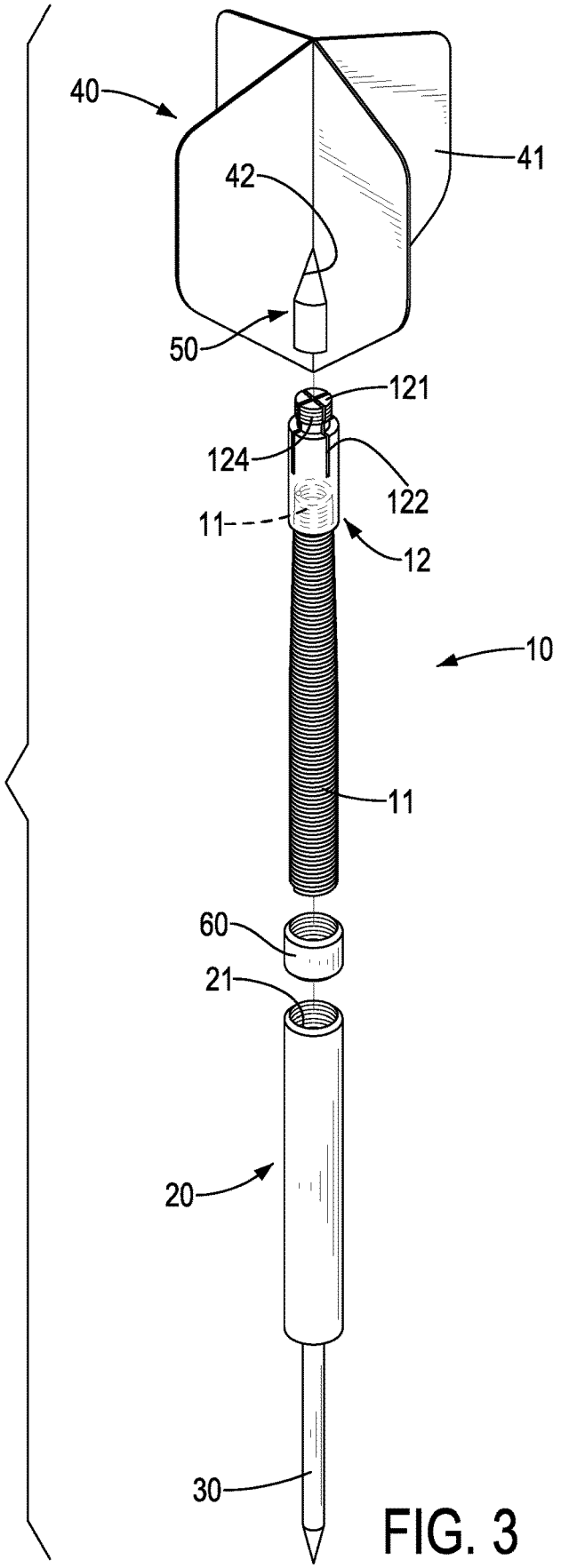
FIG. 3 is an exploded perspective view of the dart in FIG. 1.

With reference to FIGS. 1 to 3, a dart in accordance with the present invention includes a shaft 10, a barrel 20, a tip 30, a flight 40, and a cap 50.

Figure 4:
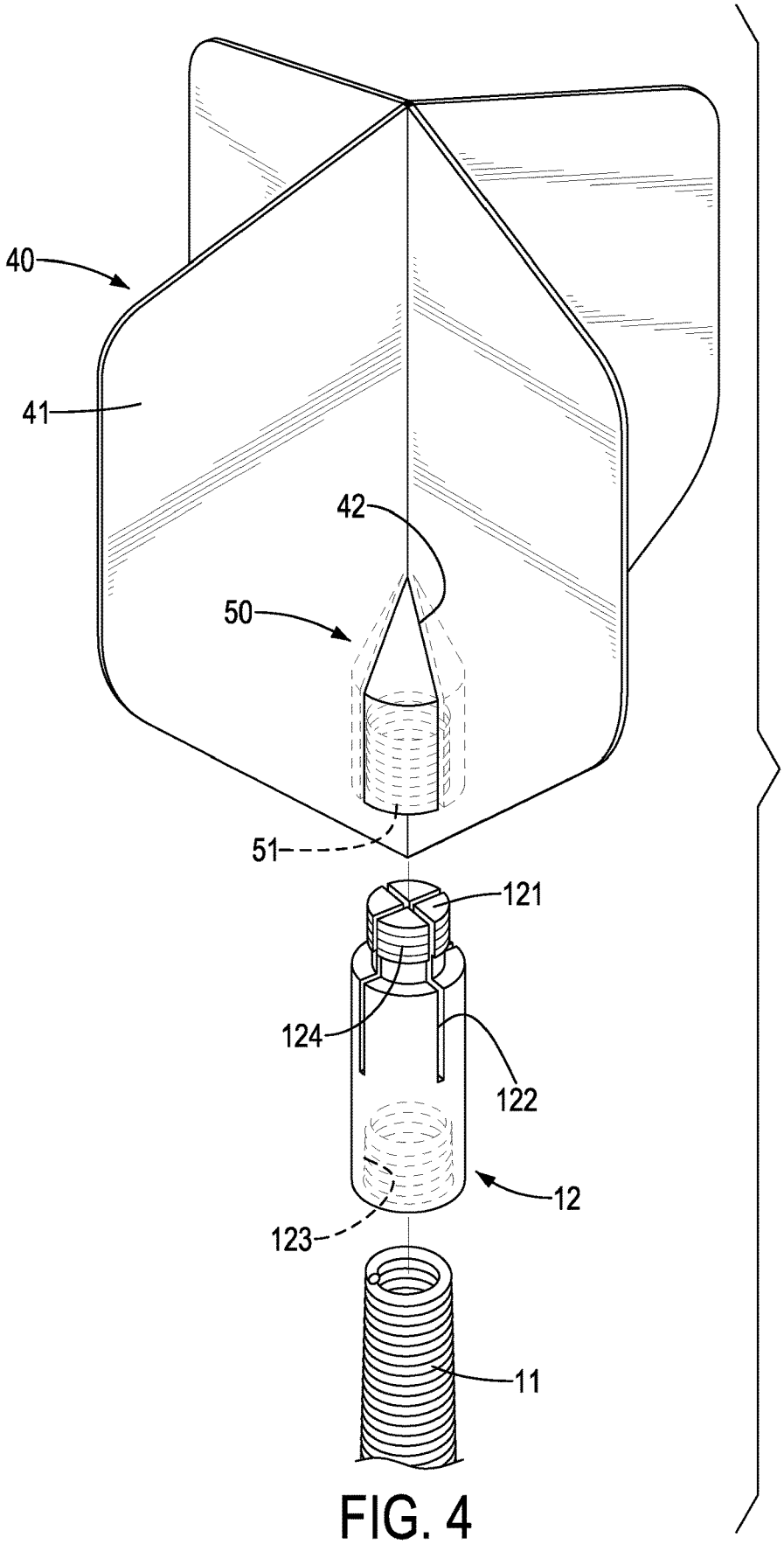
FIG. 4 is an enlarged exploded perspective view of the dart in FIG. 1.

With reference to FIGS. 3 and 4, the shaft 10 has a body 11 and a connecting element 12. The body 11 is made of flexible materials. The connecting element 12 is disposed at one of two ends of the body 11, and has a connecting section 121 and multiple insertion slits 122. The connecting section 121 is disposed at one of two ends of the connecting element 12 away from the body 11. Each one of the multiple insertion slits 122 is formed in one of the two ends of the connecting element 12 away from the body 11 along an axial direction of the connecting element 12, and the multiple insertion slits 122 are disposed at spaced intervals, communicate with one another, and form a cross slot together. Furthermore, each one of the multiple insertion slits 122 is formed in the connecting section 121 along the axial direction of the connecting element 12. Each of the multiple insertion slits 122 has two ends, one of which is an open end and is away from the body 11.

With reference to FIGS. 3 and 4, in the present invention, the body 11 is a coil spring. The connecting element 12 has a joining groove and an internal thread 123. The joining groove is formed in one of the two ends of the connecting element 12 adjacent to the body 11. The internal thread 123 is annularly disposed on an inner surface of the joining groove. When the body 11 is sleeved in the joining groove of the connecting element 12 and the connecting element 12 is connected with the body 11 via the internal thread 123, the connecting element 12 is disposed at one of the two ends of the body 11. Moreover, the body 11 may be an element in the shape of a strip and made of flexible materials, and the connecting element 12 may be integrally formed at one of the two ends of the body 11.

With reference to FIG. 3, the barrel 20 is disposed at one of two ends of the shaft 10 adjacent to the body 11. In the present invention, the barrel 20 has a threaded connecting groove 21 formed in one of two ends of the barrel 20 adjacent to the shaft 10. The barrel 20 and the shaft 10 are threaded together via the threaded connecting groove 21 and the body 11. Furthermore, the barrel 20 may be integrally formed at one of the two ends of the body 11 of the shaft 10.

With reference to FIGS. 2 and 3, in the present invention, the dart further has a nut 60 threaded onto the body 11, which is the coil spring, and located between the two ends of the body 11. After the nut 60 is threaded onto the body 11, mount the barrel 20 to the shaft 10 by having the threaded connecting groove 21 and the body 11 threaded together. When the nut 60 and the barrel 20 are both threaded onto the body 11 and the nut 60 and the barrel 20 are rotated along opposite directions onto the body 11 until the nut 60 and the barrel 20 abut against each other tightly, a friction force between the threaded connecting groove 21 of the barrel 20 and the body 11 is increased. With such a configuration, the barrel 20 will not be detached from the shaft 10 when the dart in accordance with the present invention is in use.

Figure 5:
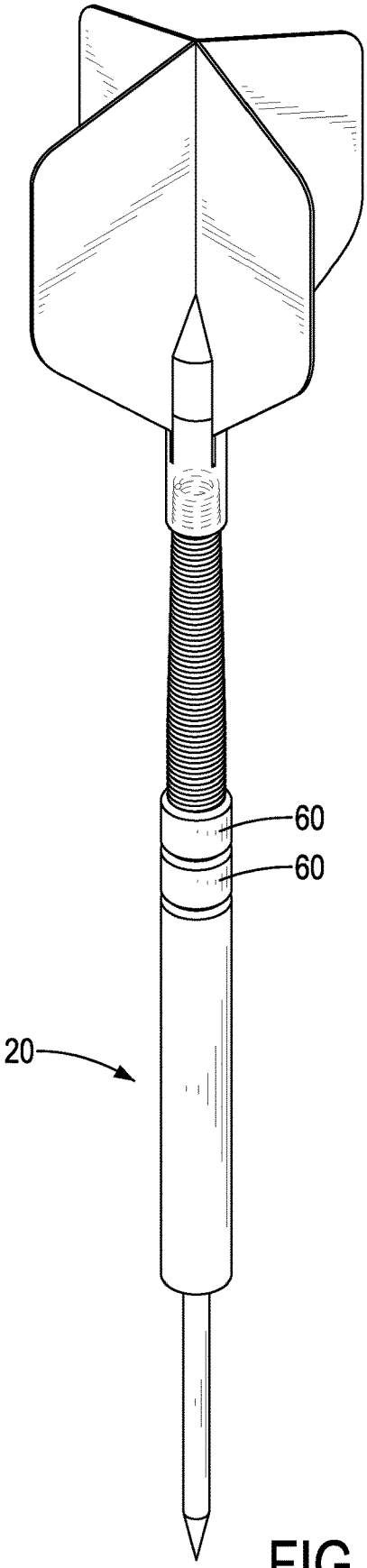
FIG. 5 is another perspective view of the dart in FIG. 1.
Figure 6:
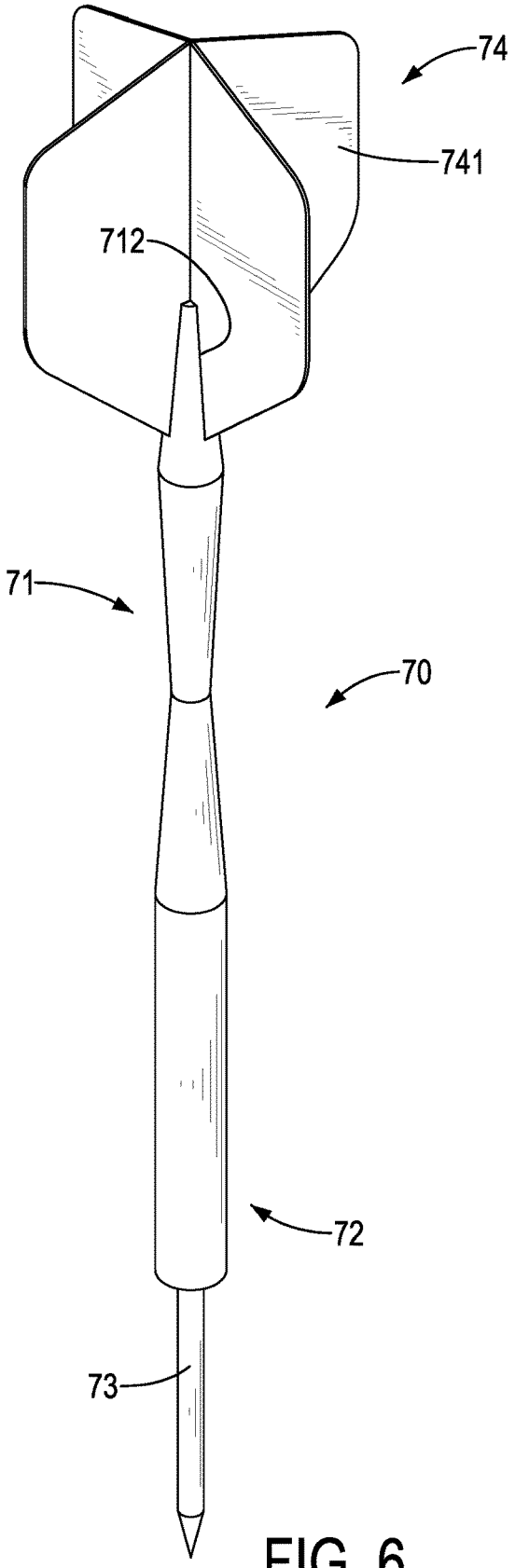
FIG. 6 PRIOR ART
FIG. 6 is a perspective view of a dart in accordance with the prior art.
Figure 7:
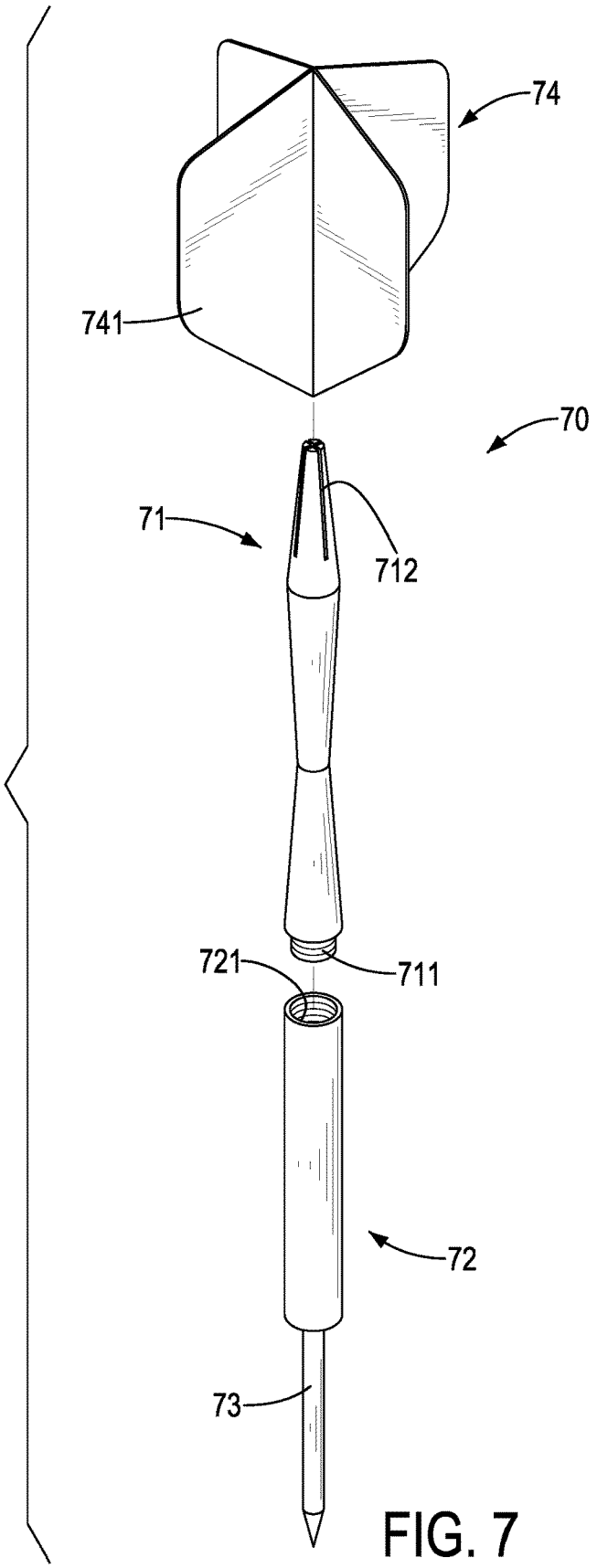
FIG. 7 PRIOR ART
FIG. 7 is an exploded perspective view of the dart in FIG. 6.

Moreover, the nut 60 can serve as a counterweight. With reference to FIG. 5, a dart player can increase a number of said nut 60 according to practical need so as to increase a weight of the dart adjacent to the barrel 20. Under this circumstance, the barrel 20 tightly abuts against one of the multiple said nuts 60 adjacent to the barrel 20.

With reference to FIGS. 1 and 2, the tip 30 is disposed at one of the two ends of the barrel 20 away from the shaft 10.

With reference to FIGS. 3 and 4, the flight 40 has multiple wings 41 and a receiving groove 42. The multiple wings 41 are disposed at spaced intervals, and each one of the multiple wings 41 can move toward or away from adjacent said wings 41, making the flight 40 a foldable structure. Each one of the multiple wings 41 is inserted into a respective one of the multiple insertion slits 122 of the connecting element 12 of the shaft 10. The receiving groove 42 is laterally formed through the multiple wings 41 and is located between two ends of the flight 40.

With reference to FIGS. 3 and 4, the cap 50 is detachably and rotatably mounted in the receiving groove 42 of the flight 40, and the cap 50 is mounted to the connecting section 122 of the connecting element 12. Mounted to the connecting section 122 of the connecting element 12, the cap 50 blocks the open end of each one of the multiple insertion slits 122 such that the open end of each one of the multiple insertion slits 122 is not exposed.

With reference to FIGS. 3 and 4, in the present invention, the connecting section 121 has an external thread 124 disposed on an outer surface thereof. The cap 50 has a threaded groove 51 disposed in one of two ends of the cap 50 adjacent to the connecting section 121. After each one of the multiple wings 41 is inserted into a respective one of the multiple insertion slits 122 of the connecting element 12 and the connecting section 121 is sleeved in the threaded groove 51, screw the cap 50 to make the threaded groove 51 engage with the connecting section 121 via the external thread 124. In such an arrangement, the cap 50 blocks the open end of each one of the multiple insertion slits 122 and makes each one of the multiple wings 41 embedded in the respective one of the multiple insertion slits 122.

To assemble the present invention, thread the nut 60, the barrel 20, and the connecting element 12 of the shaft 10 onto the body 11 of the shaft 10. Next, unfold the multiple wings 41 of the flight 40, and put the cap 50 into the receiving groove 42 of the flight 40. Then insert each one of the multiple wings 41 into the respective one of the multiple insertion slits 122 of the shaft 10. Last, screw the cap 50 to make the threaded groove 51 engage with the connecting section 121 via the external thread 124.

With the aforementioned technical characteristics, the dart in accordance with the present invention has the following advantages.

1. Since the body 11 of the shaft 10 of the present invention is made of flexible materials, the body 11 will not fracture or break due to the collision of two said darts in accordance with the present invention. Moreover, the impact caused by the collision of flexible materials is smaller than that caused by the collision of hard materials. Therefore, a flight path of the latter thrown dart in accordance with the present invention deviates more slightly when the latter thrown dart is hit by the dart that has already been stuck on a dartboard compared with a flight path of the conventional dart 70 with the shaft 71 made of hard materials when encountering the same circumstance. Thus, the latter thrown dart in accordance with the present invention is unlikely to score no point though hit by the dart stuck on the dartboard.

2. Compared with the conventional dart 70 with the four exposed insertion slits 712 that may be deformed to enlarge the intervals among the insertion slits 712 when hit by the tip 73 of the latter thrown conventional dart 70, the open end of each one of the multiple insertion slits 122 of the connecting element 12 is blocked by the cap 50 such that the open end of each one of the multiple insertion slits 122 is not exposed. With such a configuration, the flight 40 is firmly mounted to the connecting element 12 of the shaft 10.

3. Because the body 11 of the shaft 10 is made of flexible materials, the impact exerted on the body 11 is smaller than that exerted on the shaft 71 of the conventional dart 70 when falling to a ground. Thus, the body 11 of the shaft 10 is unlikely to fracture when falling to the ground.

4. The nut 60 and the barrel 20 are rotated along the opposite directions onto the body 11 until the nut 60 and the barrel 20 abut against each other tightly, such that the friction force between the threaded connecting groove 21 of the barrel 20 and the body 11 is increased. In this way, the barrel 20 will not be detached from the shaft 10 when the dart in accordance with the present invention is in use.

5. The nut 60 can serve as a counterweight. The dart player can increase the number of said nut 60 according to practical need so as to increase the weight of the dart adjacent to the barrel 20.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dart comprising:

a shaft having a body made of flexible materials; and a connecting element disposed at one of two ends of the body and having a connecting section disposed at one of two ends of the connecting element away from the body; and multiple insertion slits disposed at spaced intervals and communicating with one another, each one of the multiple insertion slits formed in the connecting element along an axial direction of the connecting element, and each one of the multiple insertion slits having two ends, one of the two ends being an open end, the open end being away from the body;

a barrel disposed at one of two ends of the shaft adjacent to the body;

a tip disposed at one of two ends of the barrel away from the shaft;

a flight having multiple wings disposed at spaced intervals, and each one of the multiple wings inserted into a respective one of the multiple insertion slits of the connecting element of the shaft; and a receiving groove formed through the multiple wings; and a cap detachably and rotatably mounted in the receiving groove of the flight, mounted to the connecting section of the connecting element, and blocking the open end of each one of the multiple insertion slits.

2. The dart as claimed in claim 1, wherein the body is a coil spring.

3. The dart as claimed in claim 2, wherein the dart has a nut threaded onto the body and located between the two ends of the body;

the barrel is threaded onto the body; and the nut and the barrel are rotated along opposite directions onto the body until the nut and the barrel abut against each other tightly.

4. The dart as claimed in claim 3, wherein the connecting element and the body are threaded together.

5. The dart as claimed in claim 3, wherein the cap is threaded onto the connecting section of the connecting element.

6. The dart as claimed in claim 2, wherein the dart has multiple nuts, and each one of the multiple nuts threaded onto the body and located between the two ends of the body;

the barrel is threaded onto the body; and the nuts and the barrel are rotated along opposite directions onto the body until the barrel abuts against one of the nuts adjacent to the barrel tightly.

7. The dart as claimed in claim 6, wherein the connecting element and the body are threaded together.

8. The dart as claimed in claim 6, wherein the cap is threaded onto the connecting section of the connecting element.

9. The dart as claimed in claim 2, wherein the connecting element and the body are threaded together.

10. The dart as claimed in claim 2, wherein the cap is threaded onto the connecting section of the connecting element.

* * * * *